US005540817A

United States Patent [19]

Schiel

[11] Patent Number: 5,540,817

[45] Date of Patent: Jul. 30, 1996

[54] METHOD AND APPARATUS FOR DETACHING A TRAVELING WEB FROM TWO WIRE BELTS

[75] Inventor: Christian Schiel, Heidenheim, Germany

[73] Assignee: J. M. Voith GmbH, Germany

[21] Appl. No.: 184,591

[22] Filed: Jan. 21, 1994

[30] Foreign Application Priority Data

Jan. 23, 1993 [DE] Germany ..... 43 01 751.7

[51] Int. Cl.[6] ..... D21F 11/04

[52] U.S. Cl. ..... 162/203; 162/205

[58] Field of Search ..... 162/203, 205, 162/301, 300, 303, 306, 210, 217, 348, 352

[56] References Cited

U.S. PATENT DOCUMENTS

| | | | |
|---|---|---|---|
| 4,430,159 | 2/1984 | Bubik et al. | 162/292 |
| 4,554,052 | 10/1985 | Waris | 162/203 |
| 5,019,214 | 5/1991 | Meinecke et al. . | |
| 5,074,966 | 12/1991 | Koivuranta | 162/301 |
| 5,306,395 | 4/1994 | Myrén | 162/301 |
| 5,389,206 | 2/1995 | Bück et al. | 162/301 |

FOREIGN PATENT DOCUMENTS 1942348 8/1969 Germany .

*Primary Examiner*—Donald E. Czaja
*Assistant Examiner*—Calvin Padgett
*Attorney, Agent, or Firm*—Osterlenk, Faber, Gerb & Soffen

[57] ABSTRACT

A method and apparatus for temporarily separating a web from one of the two wire belts in a twin wire zone in a paper making machine. In the twin wire zone, the negative pressure from a suction box is applied to the first wire belt for temporarily deflecting and separating the first wire belt and the web from the second wire belt and the wire belts then returning to contact the web following the suction box. The wire belts are then successively separated from the web by an appropriate guide and take up device. The take up device may comprise a press which includes a press nip defined by one of a suction roll over which the second wire in the web is passing or another type of roll or a flexible support device like a rotating press jacket. A smooth surface, such as that of a roll, forms a press nip with the support device for the second wire belt and after that press nip, the web adheres to the smooth surface to be transported further through the machine.

12 Claims, 3 Drawing Sheets

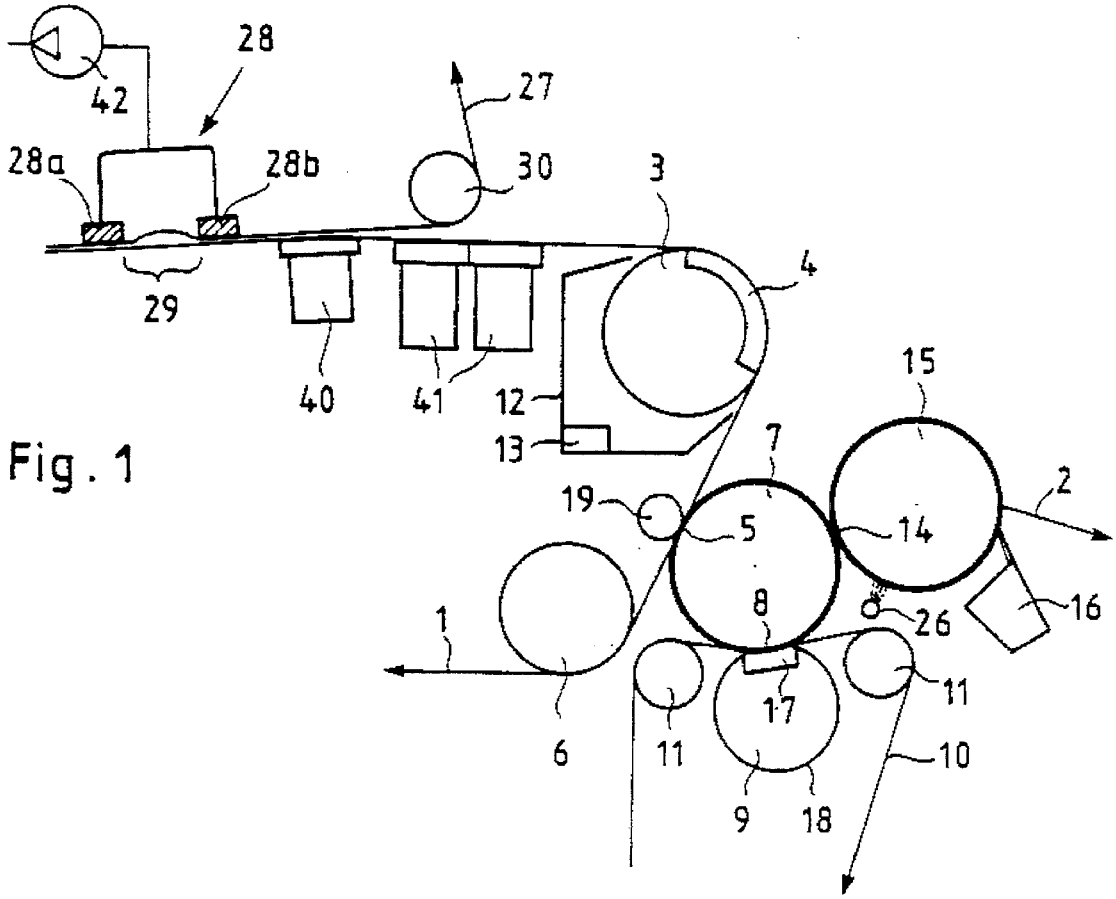
Fig. 1
Fig. 2
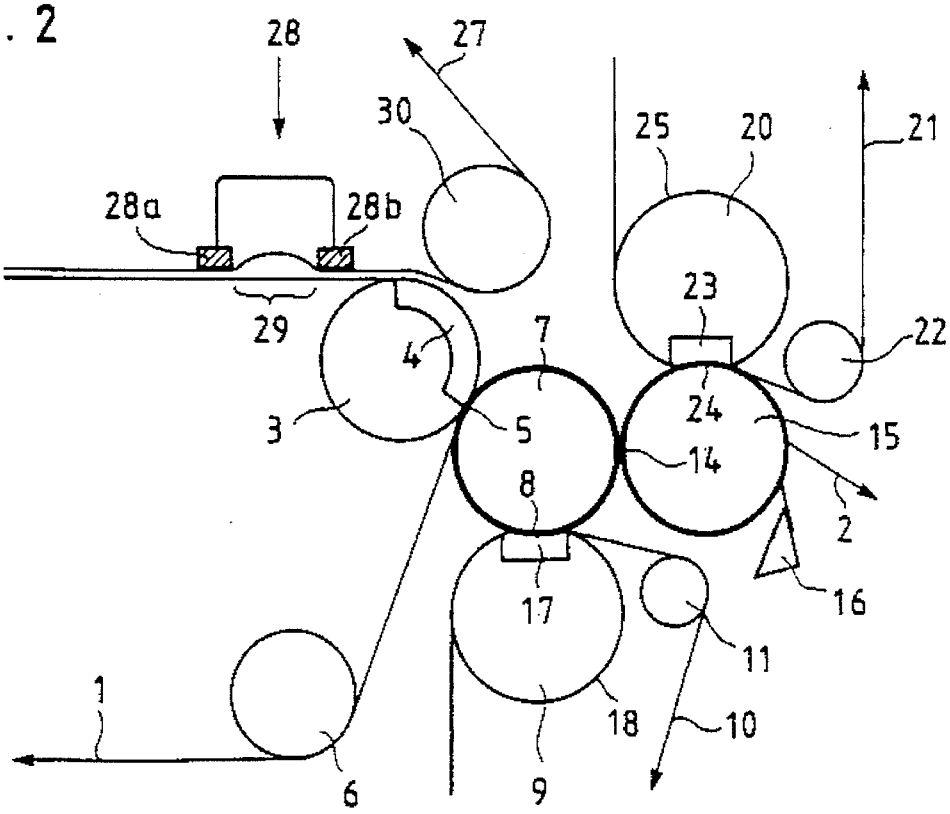

METHOD AND APPARATUS FOR DETACHING A TRAVELING WEB FROM TWO WIRE BELTS

BACKGROUND OF THE INVENTION

The present invention relates to a method of detaching a traveling fiber web from two endless rotating wire belts between which the web is being formed from a fiber suspension. The invention also relates to an apparatus for carrying out this method.

U.S. Pat. No. 5,019,214 discloses forming a fiber web, preferably a paper web, from a fiber suspension in a twin-wire former. In that case the fiber web is detached from the two endless rotating wire belts of the twin-wire former at the end of the twin-wire zone. First, one traveling wire belt, the upper wire belt in the patent, is removed from the web. The web continues to travel with the other, lower, wire belt, for instance around the circumference of a guide roll or on a so-called separation suction box which rests against the bottom of the lower wire. The other wire belt then travels, together with the web lying on top of it, over a wire suction roll, and then the web is transferred to a felt belt by means of a so-called suction pick-up roll. The felt belt conducts the fiber web into a press section for further removal of water.

The known method and the known apparatus have proven their value in practice. Improvements are desirable, particularly with respect to obtaining an even better quality of the final fiber web, particularly a paper web. Furthermore, continuous attempts are made to obtain a simpler and more compact construction for the twin-wire former and of the following press section and to increase the water removal abilities of the wire suction roll and of the press section so that greater dryness of the web is obtained as it leaves the press section.

SUMMARY OF THE INVENTION

To satisfy these requirements to the greatest extent possible, the invention proposes the following features. In the downstream region of the twin-wire zone, preferably just before the first wire belt separates from the web which then continues traveling with the second wire belt, the web is deflected, together with the first wire belt, from the straight path of travel of the second wire belt and the first wire belt and the web move through an arc pathway for a relatively short distance. Negative pressure or suction is applied to that surface of the first wire belt that is away from the web to deflect the first belt and the web. The deflection changes the respective path lengths of the first and second wire belts past the negative pressure applying means.

The negative pressure applying means comprises two support elements at spaced locations along the travel path of the wire belts against which the first wire belt is supported while suction is applied between the support elements. In this way, the fibers of the web which extend loosely into the mesh of the second wire belt, e.g. the lower wire belt, are pulled out of that wire belt. These fibers apply themselves more or less flat against the remaining part of the fiber web as a result of surface tension forces and under the action of the pressure difference which is applied at the wire belts, and particularly at the first wire belt, for causing it to deflect. As a result of the longer arcuate path traveled by the first wire as compared with the path of the second wire, the two wire belts are displaced with respect to each other in the direction of travel, so that when the web and the second wire belt reestablish contact with each other, the fibers of the web no longer enter into the same wire meshes of the second belt as before or even do not reenter into wire meshes at all. This consolidates the still relatively wet fiber web at the end of the twin-wire zone.

As a surprising consequence, upon subsequent further removal of water from the fiber web, the action of a wire suction roll, if present, is increased and a higher pressing pressure than previously can be applied at the first press nip, so that the fiber web is substantially drier following the first press nip than was previously the case. The water removal capacity of the entire press section can therefore be increased, or the number of press nips can be reduced, as compared with previous press sections, so that a more compact construction of the press section is possible.

Another advantage of the invention is that wire markings in the web can be reduced, as compared with previous forming sections. As a result, a fiber web of high quality can be obtained with simpler means than heretofore.

If necessary, the temporary arcuate deflection of the web together with the one wire belt can be repeated with the other wire belt.

As a further development of the invention, a first press nip can be provided at the point where the web is removed from the other wire belt by means of a rotating take-up device.

Other objects and features of the invention are described below with reference to the drawings.

BRIEF DESCRIPTION OF THE DRAWINGS

Each of FIGS. 1 to 5 shows diagrammatically the end region of a respective twin-wire former having a press section directly adjoining it.

DESCRIPTION OF THE PREFERRED EMBODIMENTS

Figure 3:
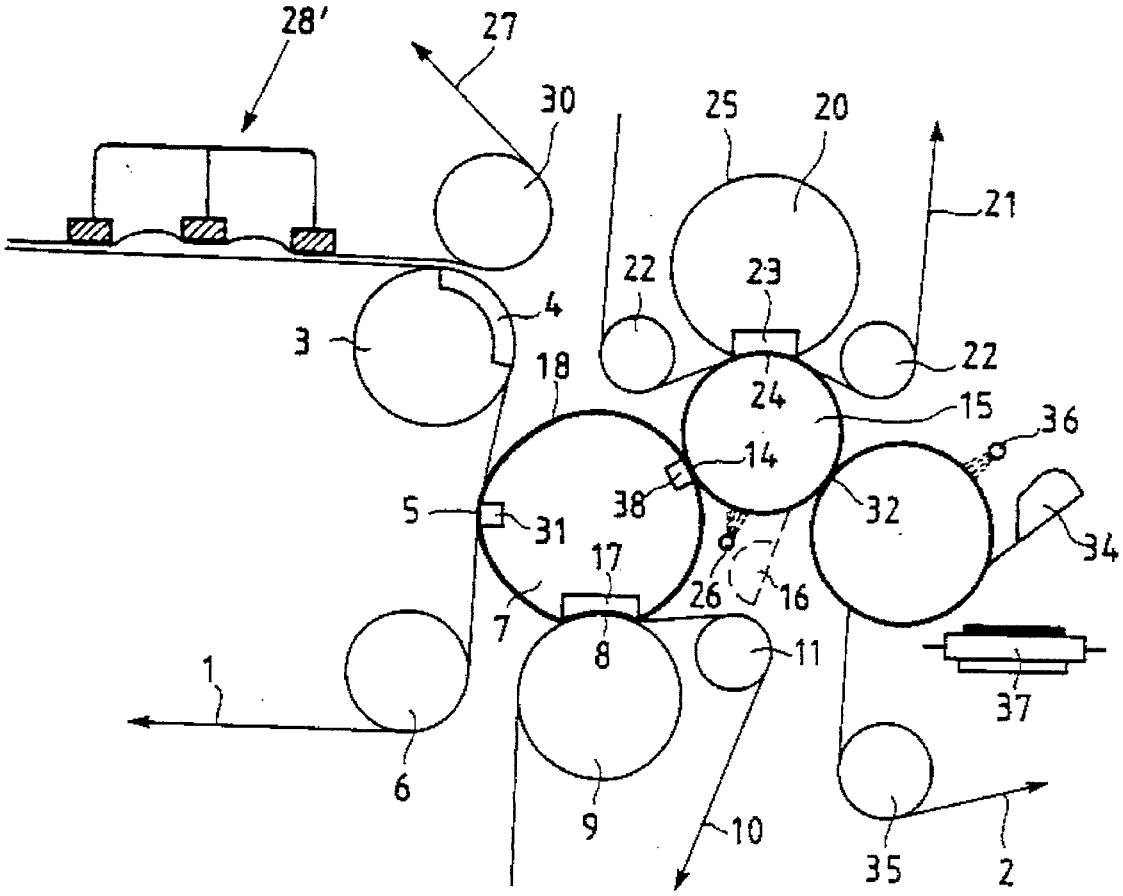

In the apparatus shown in FIG. 1, there is a lower endless loop wire belt or wire 1 and an upper endless loop wire belt or wire 27 which together define a twin-wire former of a paper making machine. The two wires travel jointly together over part of their paths with the paper web 2 present between them. They pass along the open bottom of a so called wide mouth suction chamber 28 and then pass over a separation suction box 40. At the suction box 40, the upper wire 27 detaches itself from the web of paper being formed, and the web continues traveling with the lower wire 1. The separated upper wire is returned via a guide roll 30 to the start of the twin-wire zone. The separated lower wire 1 travels together with the web 2 on it from the separation suction box 40 over further suction boxes 41, which further remove water from the web, and then moves around a wire suction roll 3 with a suction zone 4 to a first press nip 5. A water receiving trough 12 with a lateral outlet connection 13 is associated with the wire suction roll 3.

The first press nip 5 is formed between two press rolls 7 and 19. The lower wire 1 continues from the first nip 5 over a guide roll 6, and then returns to the start of the twin-wire zone. The paper web 2 is transferred at the first press nip 5 from the wire 1 onto the smooth surface of the press roll 7.

While adhering to the roll 7, the web enters the second press nip 8, which is defined between the roll 7 and another press roll 9. Press roll 9 is shown as a conventional shoe press roll having a stationary press shoe 17 with a concave pressing surface in the region of the press nip 8 over which, in known manner, there is an applied layer of lubricant on which slides a flexible press jacket 18 of plastic. For clarity of the drawing, standard load bearing parts, such as frame, shaft and bearings, have not been shown.

A press felt 10, shown only in part, is conducted through the press nip 8 together with the paper web 2 which is supported on the side of the felt toward the press roll 7. The path of the felt 10 both upstream of and downstream of the press nip 8 is determined by the felt guide rolls 11. The ordinary additional devices on the endlessly rotating press felt 10, such as water removal and cleaning elements, for instance, a felt suction box, felt tensioning roll, regulating roll and possibly additional guide rolls, are not shown.

A third press nip 14 is defined between the press roll 7 and another roll 15. The web of paper 2, which is adhering to the surface of the roll 7 and without a felt on either surface of the web, is again pressed in the third nip. The web leaves the third press nip 14 in contact with the surface of the roll 15 and is thereafter removed from the roll 15 at a certain distance before a scraper 16. This removal can be effected by pulling on the web without a support or by contact of the web with another support surface which the web 2 follows after detachment from the roll 15, for instance, a felt, a dryer wire, a belt, or a roll.

The wide mouth suction chamber 28 is a box which is open on the bottom. It has two support ledges **28*a* and 28*b* on its lower side, which extend transverse to the direction of travel of the web. A fan 42 produces a negative pressure within the box. Between the support ledges 28*a*, 28*b*, along the web path, there is a relatively wide space or suction slot 29. In place of the suction ledges 28*a*, 28*b***, stationary or rotatable round bars or hydraulically supported rolls can be provided, as suggested in Federal Republic of Germany No. 41 05 215.

The paper web 2 is brought to the wide mouthed suction chamber 28 between the lower wire 1 and the upper wire 27. The web is deflected upward together with wire 27 away from the lower wire 1 along a deflected pathway in the shape of an arc into the suction slot 29. The loose fibers of the web 2, which had extended downward into the meshes of the wire 1, are pulled out of the wire 1 and apply themselves, via the forces of surface tension and the action of the negative pressure in the suction chamber 28, flat against the paper web 2. Upon the subsequent removal of water either via a wire suction roll or in a press nip, the wire meshes are again open and are capable of storing water. As a result of the smaller water retaining paper web surface, there is less remoistening from the wire meshes back into the paper web. Furthermore, due to the lengthening of the path of wire 27, as compared to the path of the wire 1, past the chamber 28, the two wires are relatively displaced in the direction of web and wire travel. When the lower wire 1 and the web 2 again come into contact with each other after the suction chamber 28, the loose fibers no longer fit on the same wire meshes. This consolidates the paper web 2 and leaves the wire meshes open. Thus, the dewatering effect of suction boxes 40, 41 and of suction roll 3 and of press nip 5 is improved, producing greater web dryness at the first press nip 5. Furthermore, wire markings in the web 2 are thereby reduced.

The length of the slot 29 in the web travel direction is preferably between 50 and 150 mm. Several slots of a width of more than 40 mm can also be used. See, for example, the wide mouth suction chamber 28' of FIG. 3.

FIG. 2 shows a wet press arrangement that is similar to that shown in FIG. 1. The same parts have been identified by the same numerals. The suction boxes 40, 41 are absent from the arrangement in FIG. 2. The wide mouth suction chamber 28 is arranged directly upstream of the wire suction roll 3. The roll 3 is wrapped by the lower wire 1. Over a small part of its circumference, it is also wrapped by the upper wire 27, and that wire returns from that partial wrap over the guide roll 30.

Between the third press nip 14 and the scraper 16 there is an additional fourth press nip 24 between the press roll 15 and a press roll 20 having a press shoe and a rotating flexible press jacket 25 over the press shoe. A press felt 21 travels over the press jacket 25 into the press nip 24 and then over a guide roll 22.

As a result of the symmetrical removal of water from the web, in the press nip 8 on the lower side of the web into the press felt 10 and in the press nip 24 on the top side of the web into the press felt 21, minimal structural two sidedness of the web is assured. At the third press nip 14, no water can be removed from the web 2 since no water absorbing felt is present there. The third press nip 14 serves merely to transfer the web 2 from roll 7 to roll 15. The transfer from roll 7 to roll 15 is effected either because roll 15 has a harder surface than roll 7 and/or by the moistening of the surface of roll 15, for instance, by means of a roller type doctor or a spray pipe 26 (not shown).

A water collection trough (12 in FIG. 1) below the wire suction roll 3 is not shown in FIG. 2, but could be employed.

The first press nip 5 is formed directly between the rolls 3 and 7. Due to the large diameters of the rolls 3 and 7, pressing can be done with considerable linear force already at this first press nip, so that the paper web passes with relatively great dryness into the second press nip 8. As a result, the press nip 8 is more efficient.

The arrangement in FIG. 3 generally corresponds to the arrangement in FIG. 2. It is different from FIG. 2, in that the roll 9 in FIG. 3 is rigid. Further, the roll 7 is developed as a shoe press roll with a flexible jacket 18. The flexible press jacket 18 is bulged to the outside by support ledges 31 and 38 at the press nips 5 and 14.

In a fifth press nip 32 between the roll 15 and the roll 33, the web of paper is smoothed on both sides. Since the peripheral surface layer of the roll 33 is harder than that of the roll 15, a stronger smoothing effect is obtained on the top side of the paper web, which is structured rougher by the felt 21, than on the bottom side of the web, so that the emerging paper web 2 has substantially equal roughnesses on both sides. The web 2 travels further over guide roll 35 to the drying section. A scraper 34 cleans the surface of the roll 33. A scraper 16 can be associated with the roll 15, if necessary.

Moistening spray pipes 26 and 36 can be provided to facilitate the transfer of the web to the desired roll surfaces. These are provided upstream of the press nips 14 and 32. For the removal of broke, which can collect at the scraper 34, a conveyor belt 37 is provided which extends transversely over the width of the machine.

Figure 4:
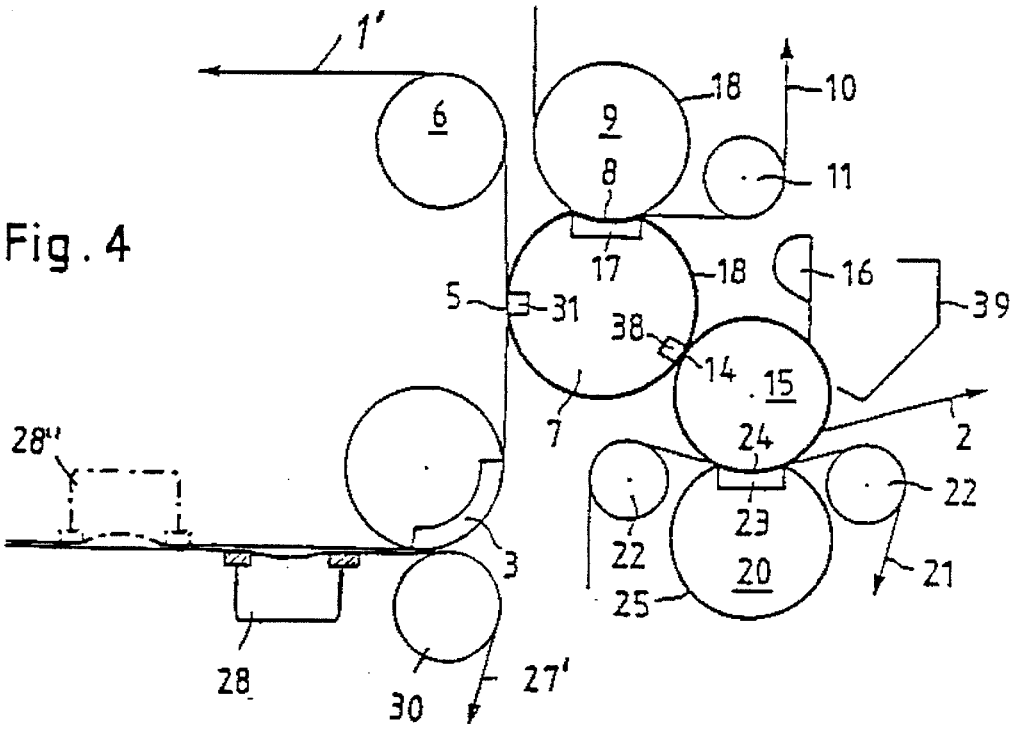

In FIG. 4, the upper wire belt 1' and the lower wire belt 27' with the web 2 sandwiched therebetween, travel across the open top side of the wide mouth suction chamber 28, which contacts the lower wire belt 27', and then to suction roll 3, around which the upper wire belt 1' is partially wrapped. Here the lower wire 27' is removed away from the web and the upper wire 1'. If required, upstream of chamber 28, an additional wide mouth suction chamber 28 may be provided which contacts the upper wire belt 1' whereby first the upper belt 1' and then the lower belt 27' would be deflected along with the web. As a result, both the bottom side and thereafter the top side of the web would be freed from the respective wire belts enabling both surfaces of the web to be smoothed.

The paper web path continues where it is removed at nip 5 onto the surface of the press jacket 18 of the first, shoe press roll 7, travels on the surface 18 through the second press nip 8 defined by press shoe 17 acting on the press jacket 18 against the web and the felt 10 in the nip and the second tubular press roll 9, travels on the press jacket 18 through the third nip 14 defined by the third press roll 15 and the press jacket 18 at the ledge 38 in the jacket, travels on the surface of the third press roll 15 into the fourth nip 24 defined between the third press roll 15 and the press jacket 25 of the shoe press roll 20 at the shoe 23, which fourth nip is felted by the felt 21, and then the web moves out of the machine. Further details of the press roll arrangement may be found in a co-pending application filed the same day as this one, entitled "Method and Apparatus for Removing Water from a Web by Means of Presses" and filed by the same assignee hereof.

Figure 5:
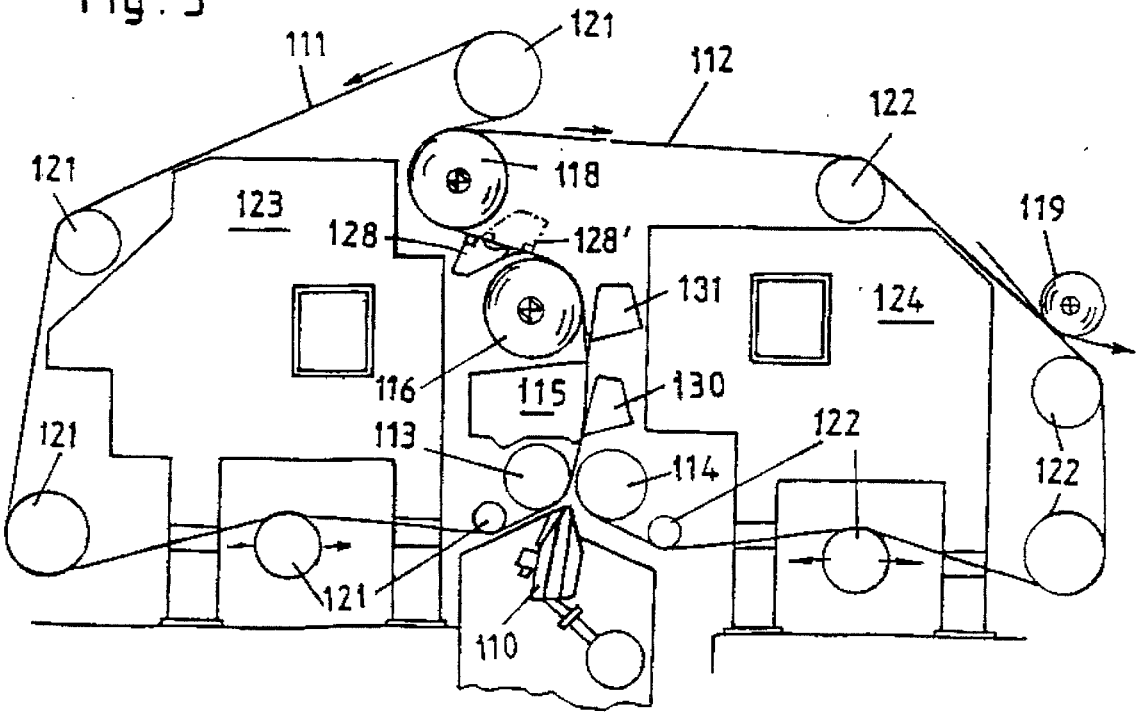

FIG. 5 is similar to FIG. 1 of U.S. Pat. No. 5,141,600, incorporated herein by reference. Upstream of wire suction roll 118, which contacts the second wire 112, the two wires 111 and 112 travel over the open side of a wide mouth suction chamber 128, which contacts the first wire 111 improving the dewatering effect of roll 118. If required, instead of or even alternately in addition to the chamber 128, a similar chamber 128' may contact the second wire 112. Other elements of FIG. 5 hereof are described in the above U.S. Pat. No. 5,141,600.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method of detaching a travelling fiber web, which has been formed from a fiber suspension, from two endless rotating wire belts in a paper making machine, comprising:

moving a first and a second wire belt along a travel path with the web held between opposed surfaces of the first and second wire belts in a twin-wire zone;

contacting the first wire belt at two locations spaced a distance apart along the path of the first wire belt while moving the first and second wire belts together past the two locations;

deflecting the first wire belt and the web away from and out of the travel path of the second wire belt and in the space between the locations, in a manner such that the lengths of the path of the first wire belt and the web are different from that of the second wire belt between the two locations, and retaining the web on the first wire belt on the path between the locations;

generally at a downstream one of the locations recontacting both of the first and second wire belts with the web for travelling together;

subsequently along the travel path, removing one of the wire belts from the web and removing the web from the other of the wire belts.

2. The method of claim 1, wherein the deflecting of the first wire belt from the second wire belt is accomplished by applying a pressure difference to the wire belts between the locations for separating the first wire belt and the web from the second wire belt.

3. The method of claim 2, wherein the pressure difference is applied between the locations for moving the web together with the first wire belt out of the travel path of the second wire belt from which the web is separated between the locations.

4. The method of claim 3, wherein the pressure difference is applied by applying negative pressure to that surface of the first wire belt away from the second wire belt and between the locations.

5. The method of claim 3, wherein there are wire support elements at the locations and the first wire is deflected against the support elements.

6. The method of claim 5, wherein there are at least two of the support elements which are in the form of support ledges against which the first wire belt is deflected by the application of said pressure difference.

7. The method of claim 6, wherein the pressure difference is applied by applying negative pressure to that surface of the first wire belt away from the second wire belt and between the locations.

8. The method of claim 3, further comprising along the path of the wire belts and outside the path between the locations, conducting the second wire belt over second spaced apart locations and between the second locations, applying a pressure to the second wire belt to temporarily deflect the second wire belt out of the path of travel of the first wire belt.

9. The method of claim 8, wherein the second wire belt is deflected by applying differential pressure to the second wire belt.

10. The method of claim 1, wherein the two spaced locations are at the downstream end of the twin-wire zone.

11. A method of detaching a travelling fiber web, which has been formed from a fiber suspension, from two endless rotating wire belts in a paper making machine, comprising:

moving a first and a second wire belt along a travel path with the web held between opposed surfaces of the first and second wire belts in a twin-wire zone;

contacting and supporting the first wire belt at two locations spaced a distance apart along the path of the first wire belt while moving the first and second wire belts together past the two locations, the two locations being at a downstream end of the twin-wire zone;

deflecting the first wire belt and the web away from and out of the travel path of the second wire belt and in the space between the locations by applying a pressure difference between the two locations, in a manner such that the lengths of the path of the first wire belt and the web are different from that of the second wire belt between the two locations, and retaining the web on the first wire belt on the path between the locations;

generally at a downstream one of the locations recontacting both of the first and second wire belts with the web for travelling together;

subsequently along the travel path, removing one of the wire belts from the web and removing the web from the other of the wire belts.

12. A method of detaching a travelling fiber web, which has been formed from a fiber suspension, from two endless rotating wire belts in a paper making machine having a twin-wire zone, comprising:

moving a first and a second wire belt along a travel path with the web held between opposed surfaces of the first and second wire belts in the twin-wire zone;

contacting the first wire belt at two locations spaced a distance apart along the path of the first wire belt while moving the first and second wire belts together past the two locations, the two locations being disposed at a downstream portion of the twin-wire zone;

deflecting the first wire belt and the web away from and out of the travel path of the second wire belt and in the space between the locations, in a manner such that the lengths of the path of the first wire belt and the web are different from that of the second wire belt between the two locations, and retaining the web on the first wire belt on the path between the locations; and generally at a downstream one of the locations recontacting both of the first and second wire belts with the web for travelling together.

* * * * *